US005842797A

United States Patent [19]

Lee

[11] Patent Number: 5,842,797

[45] Date of Patent: Dec. 1, 1998

[54] APPARATUS FOR CHANGING A RIBBON-COLOR OF A PRINTER

[75] Inventor: Kyu Bok Lee, Kyunggi-do, Rep. of Korea

[73] Assignee: Samsung Electro-Mechanics Co., Ltd, Suwon, Rep. of Korea

[21] Appl. No.: 976,547

[22] Filed: Nov. 24, 1997

[30] Foreign Application Priority Data

Nov. 30, 1996 [KR] Rep. of Korea ..... 1996-60384

[51] Int. Cl.[6] ..... B41J 33/54

[52] U.S. Cl. ..... 400/216.1; 400/212

[58] Field of Search ..... 400/216.1, 212, 400/211, 217, 216.2, 695, 697.1

[56] References Cited

U.S. PATENT DOCUMENTS

| | | | |
|---|---|---|---|
| 4,563,100 | 1/1986 | Hamamichi | 400/212 |
| 4,693,619 | 9/1987 | Ishii et al. | 400/216.1 |
| 4,741,638 | 5/1988 | Okabayashi et al. | 400/212 |
| 4,773,777 | 9/1988 | Gomoll et al. | 400/216.1 |
| 4,884,907 | 12/1989 | Yasumi | 400/216.1 |
| 4,983,057 | 1/1991 | Akiyama et al. . | |
| 5,183,345 | 2/1993 | Suzuki | 400/212 |

*Primary Examiner*—Edgar Burr
*Assistant Examiner*—Anthony H. Nguyen
*Attorney, Agent, or Firm*—Ladas & Parry

[57] ABSTRACT

In a multi-color changing apparatus of a small-sized printer, a ribbon color of the printer can be changed by a novel structure highly suitable as a ribbon-cartridge converting apparatus for two colors not for four colors because of its simple structure to enhance productivity and lower manufacturing cost without a high-priced stepping motor. The apparatus includes a pair of side frames in right and left installed with parts for forming the small-sized printer while having supporting plates pair projecting to rear corners, a cartridge frame connected to be rotatable about a pin by inserting extending plates at the rear sides into the supporting plates while having a c-shaped cam guider extending to one side thereof, a driven shaft installed to the side frames while having a lead screw for transferring a print head and an externally-expanding one end, a shift cam placed into the inside of the cam guider of the cartridge frame by being fitted to run idling at the edge end of the driven shaft, a shift ratchet fixedly attached to the driven shaft onto the immediate inside of the shift cam while having hooking jaws onto the outer periphery thereof, a clutch spring inserted between the shift cam and shift ratchet while having both edge ends respectively fixed to the shift cam and shift ratchet, and a solenoid fixed to the side frames for catching an operating end to the hooking jaws of the shift ratchet. Here, the shift ratchet, clutch spring and shift cam are rotated along with the rotation of the driven shaft by a frictional force to swing up and down the cartridge frame by the shift cam.

3 Claims, 5 Drawing Sheets

APPARATUS FOR CHANGING A RIBBON-COLOR OF A PRINTER

BACKGROUND OF THE INVENTION

1. Field of the Invention

The present invention relates to an apparatus for changing a ribbon-color of a printer, and more particularly to an ribbon-apparatus for changing a ribbon-color of a printer, wherein a ribbon of a cartridge is painted in two colors, and then the position of the cartridge is to ascend/descend for changing the color printed onto a sheet of paper.

2. Description of the Prior Art

A small-sized printer is generally employed for an electronic cash register, in which a sheet of paper that is curled up in the form of a roll is successively supplied between a printing plate and a cartridge ribbon, and a printer head prints the item name, amount and so on over the sheet of paper.

Such a conventional small-sized printer is disclosed in U.S. Pat. No. 4,773,777 as shown in FIG. 1 and U.S. Pat. No. 4,983,057 as shown in FIG. 2.

The multi-color changing apparatus shown in FIG. 1 enables a ribbon cartridge a1 to swing about a hinge pin a2, and the bottom plane of ribbon cartridge a1 is supported by a polygonal cam a4 which is fixedly attached to a driven shaft a3. Here, driven shaft a3 is rotated by a motive power of a motor by interposing a deceleration gear as a medium, and the instruction of operating the motor is produced from a separate control mechanism. The characteristic of the multi-color changing apparatus is in that a ribbon a5 is painted in four colors to allow for precisely regulating the height adjustment by four steps.

The multi-color changing apparatus shown in FIG. 2 which enables a ribbon cartridge b1 to swing about a hinge pin 3 includes a supporting member b2 extending down from the side of ribbon cartridge b1, and a semi-circular gear b3 furnished to underlie supporting member b2. In addition, a motive power transferring structure b4 is formed by a deceleration gear and a motor, and a control mechanism is provided for operating motive power transferring structure b4. Here, the height of ribbon cartridge b1 also can be adjusted by several steps, using the plurality of gears.

However, since both the above-described conventional structures are of the color changing apparatus of the ribbon cartridge having four colors to involve a complicated operating mechanism, the multi-color changing apparatuses have drawbacks of incurring high cost in manufacturing, being difficult to be manufactured, etc.

More specifically, in case of that shown in FIG. 1, an easily-controllable stepping motor should be employed for precisely rotating driven shaft a3 fixedly attached with polygonal cam a4. Likewise, in case of that shown in FIG. 2, a high-priced stepping motor should be employed in order to operate semicircular gear b3 and motive power transferring structure b4 while accurately controlling them.

Additionally, those require a separate control equipment for accurately controlling the number of revolution of the aforementioned stepping motor to further increase the manufacturing cost, which are therefore unsuitable in realizing just two-color changing apparatus.

SUMMARY OF THE INVENTION

The present invention is devised to solve the foregoing problems of the prior arts. Therefore, it is an object of the present invention to provide an apparatus for changing a ribbon-color, wherein the main purpose is for changing a ribbon color of a small-sized printer, having a novel structure highly suitable as an apparatus for converting a ribbon cartridge just for two colors not for four colors because of its simple structure to be favorable for enhancing productivity and incurring low manufacturing cost without employing a high-priced part such as a stepping motor.

To achieve the above object of the present invention, a characteristic construction of the present is an apparatus for changing a ribbon-color of a printer, which includes side frames installed with respective parts for forming said printer, and formed with a pair of supporting plates projecting to respective rear corners. A cartridge frame is connected to be rotatable about a pin by inserting both extending plates at the rear sides thereof into the supporting plates of both side frames, which has a cam guider positioned to one side thereof. Also, a driven shaft installed to the both side frames is formed with a lead screw for transferring a print head and a shift cam is fitted to run idling at the edge end of the driven shaft. In addition, a shift ratchet fixedly attached to the driven shaft onto the immediate inside of the shift cam has hooking jaws onto the outer periphery thereof, and a clutching means inserted between the shift cam and shift ratchet has both edge ends respectively fixed to the shift cam and shift ratchet. Furthermore, a hooking means is fixed to the side frames for leading an operating end thereof to be caught to the hooking jaws of the shift ratchet. By this construction, the shift ratchet, clutch spring and shift cam are rotated in accordance with the rotation of the driven shaft by a frictional force to be capable of swinging up and down the cartridge frame by the shift cam.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENT

Figure 1:
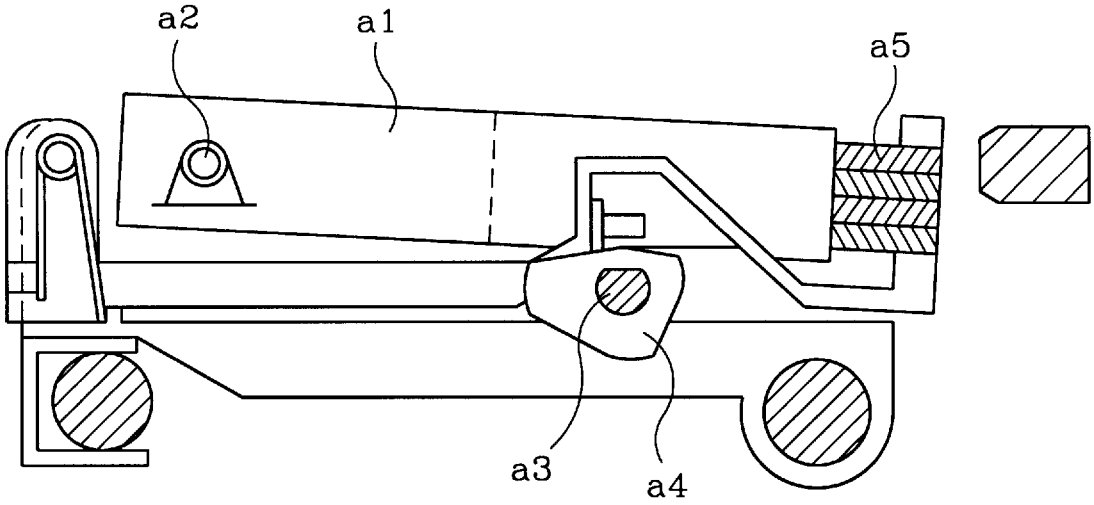
FIG. 1 is a side view showing a construction of a conventional ribbon-color changing apparatus.
Figure 2:
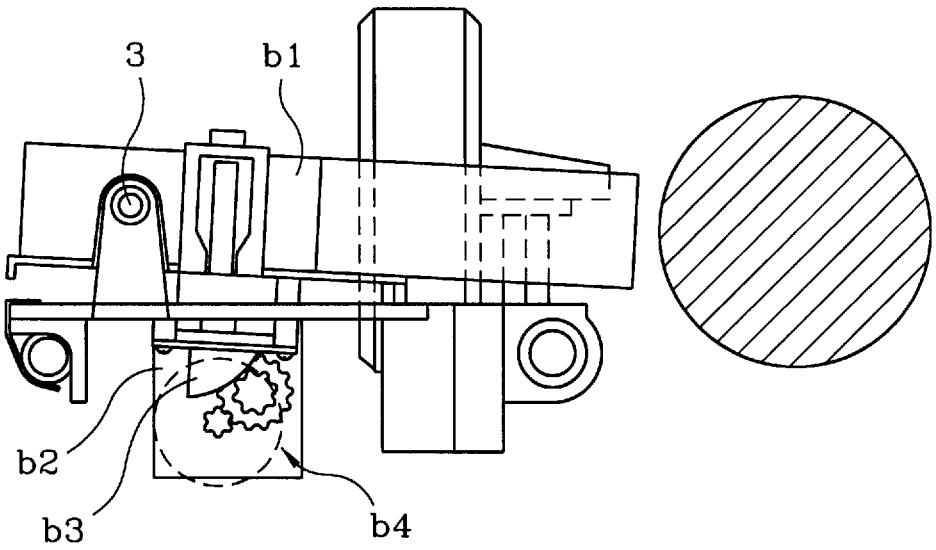
FIG. 2 is a side view showing a construction of another conventional ribbon-color changing apparatus.
Figure 3:
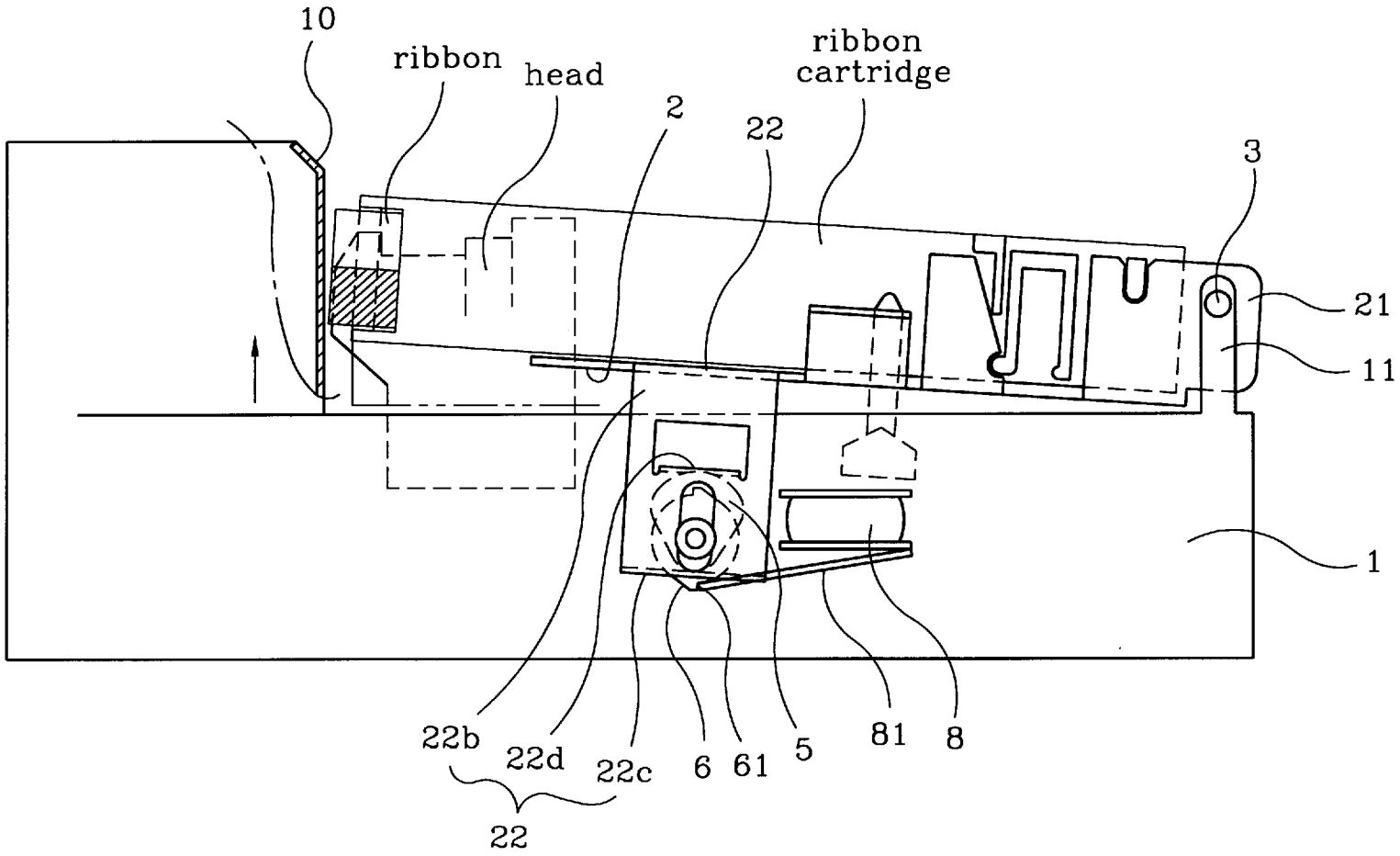
FIG. 3 is a side view showing a construction of a ribbon-color changing apparatus according to the present invention.
Figure 4:
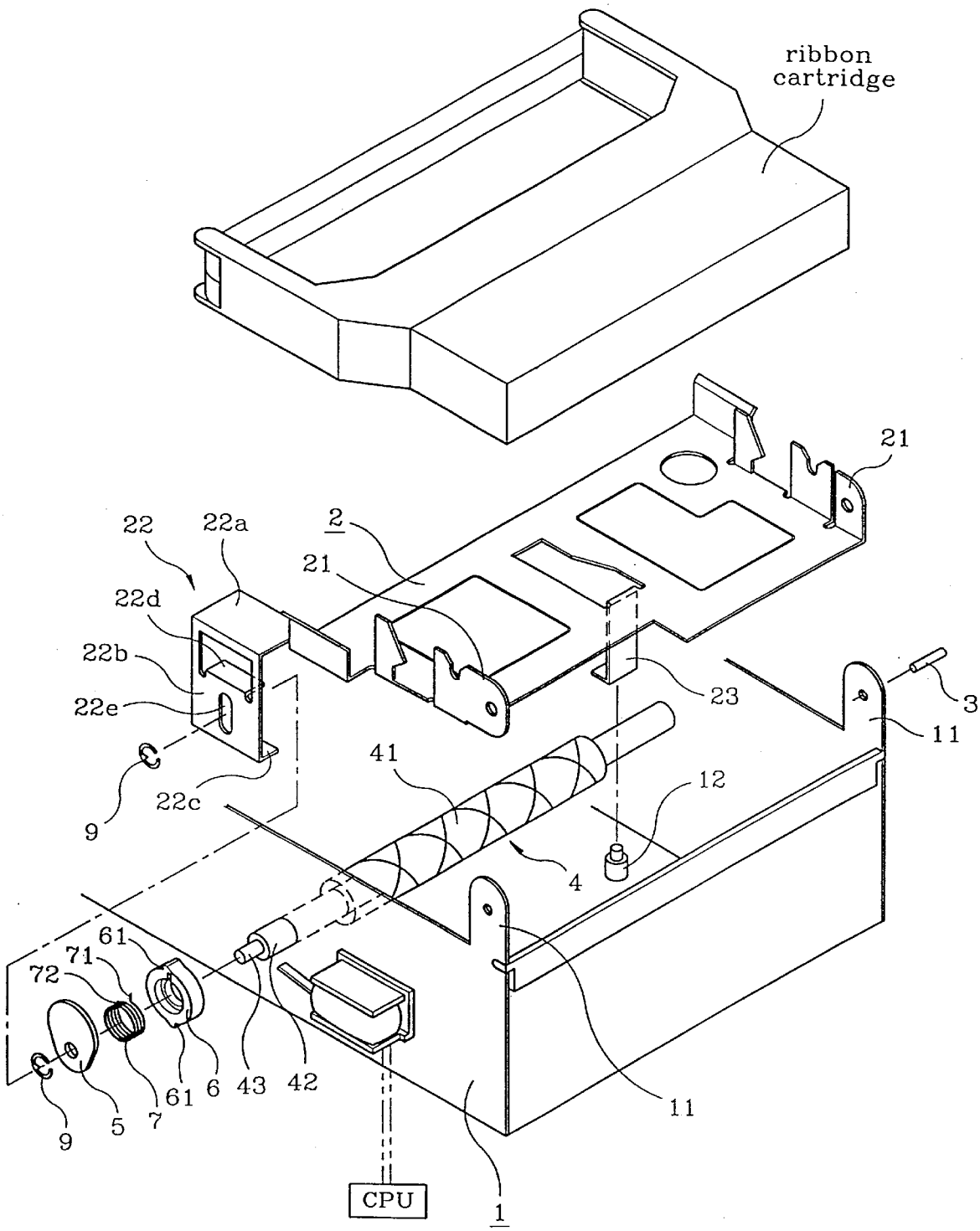
FIG. 4 is an exploded perspective view showing a detailed construction of the ribbon-color changing apparatus according to the present invention.

FIG. 3 is a side view showing a state of installing a ribbon-color changing apparatus of a small-sized printer according to the present invention, and FIG. 4 is an exploded perspective view showing a detailed construction of the ribbon-color changing apparatus according to the present invention.

As shown in FIGS. 3 and 4, the ribbon-color changing apparatus is installed to side frames 1 of a printer main body that constitute the small-sized printer.

Side frames 1 are the frame erected into both right and left of the main body, which are installed with a driven shaft 4 having a head-transferring lead screw 41, a guide shaft, a platen 10, a paper feed roller, and so on between them. Also, a plurality of gears (not shown) for driving the parts are installed to both sides of side frames 1.

Especially, sides frames 1 of the present invention are formed with supporting plates 11 projecting upward at their corners of both rear sides, and supporting plates 11 are connected with a cartridge frame 2 of the present invention to be rotatable by means of a pin 3.

In more detail, cartridge frame 2 is characterized by being formed with extending plates 21 at both rear sides thereof, so that it is connected to supporting plates 11 of side frames 1 by means of pin 3 while being formed with a cam guider 22 to one side thereof.

Cam guider 22 has a horizontal part 22*a* obtained by horizontally extending the bottom portion of cartridge frame 2, a vertical part 22*b* obtained by bending from horizontal part 22*a* to extend downward, and a lower part 22*c* bent inward from vertical part 22*b,* thereby being provided in the shape of c.

The middle portion of vertical part 22*b* is partially cut to bend inward to form a middle part 22*d,* so that middle part 22*d* and lower part 22*c* which will be described later become a substantial guider of a shift cam 5 to be described later.

Figure 5:
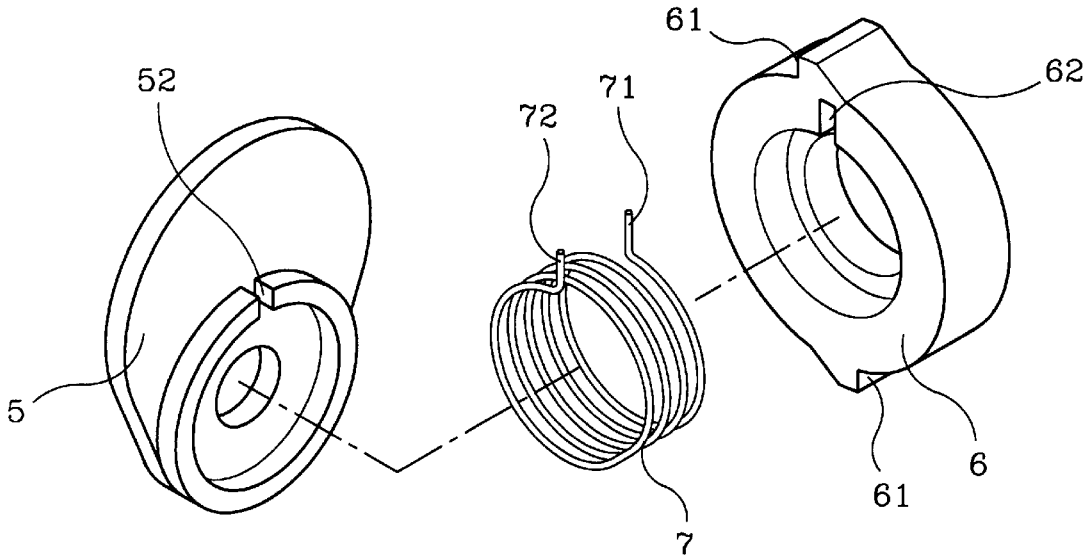
FIG. 5 is an exploded perspective view showing a construction of the major parts of the present invention.

Driven shaft 4 having a lead screw 41 is installed between side frames 1 in a manner that a shaft end part 42 of driven shaft 4 protrudes through the side of side frames 1, and a shift ratchet 6, a clutch spring 7 and shift cam 5 are assembled to shaft end part 42 as shown in FIG. 5.

Figure 6:
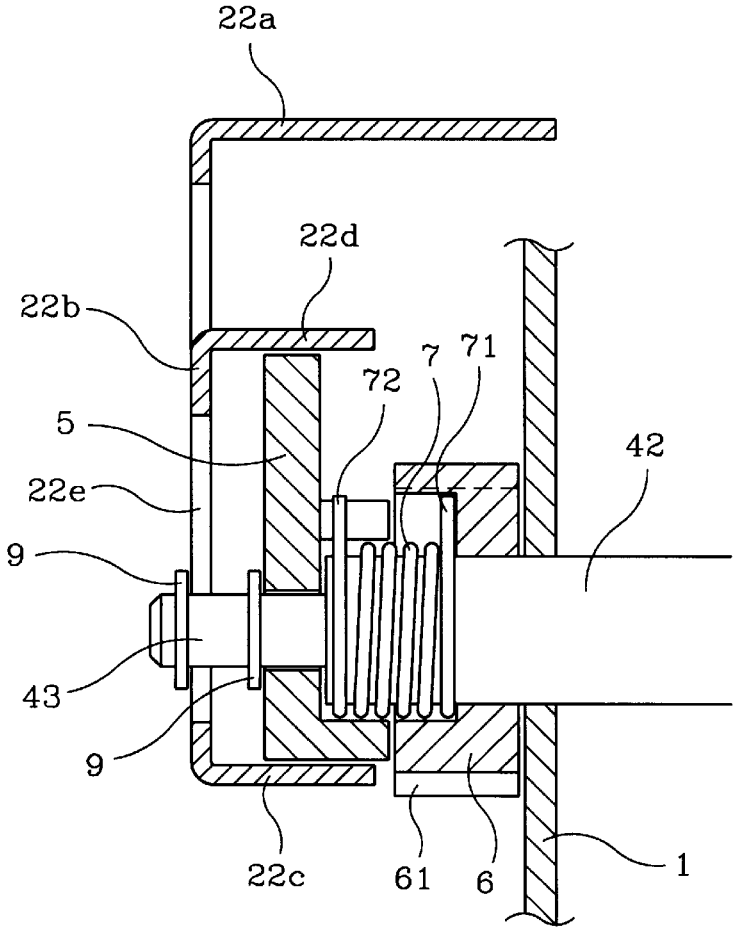
FIG. 6 is an enlarged sectional view showing a state before operating the ribbon-color changing apparatus according to the present invention.
Figure 7:
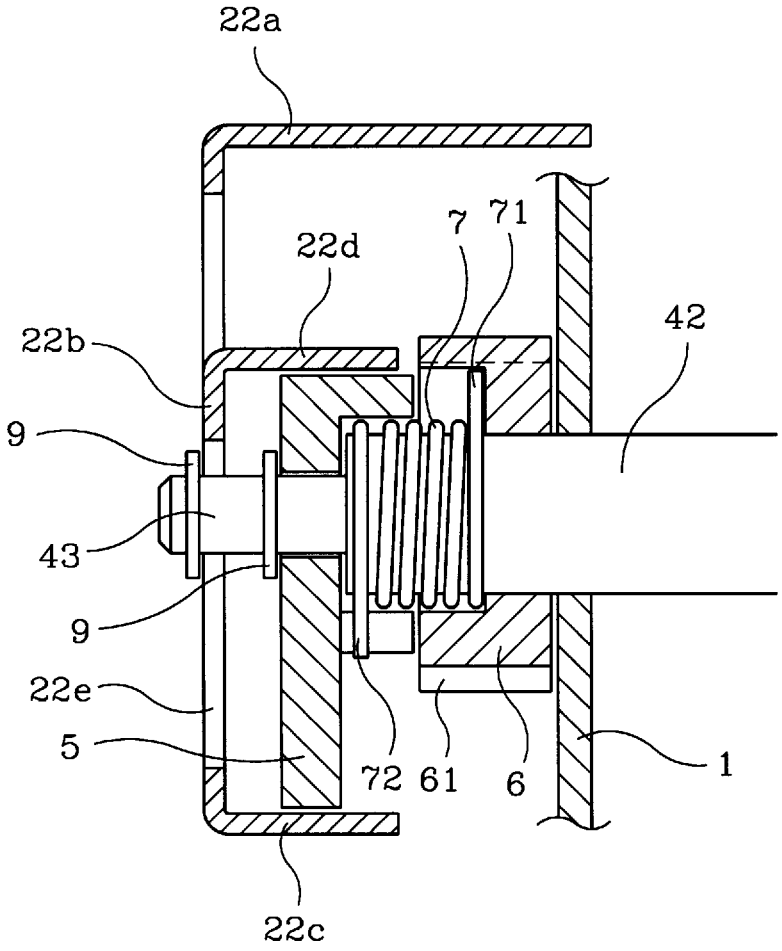
FIG. 7 is an enlarged sectional view showing a state after operating the ribbon-color changing apparatus according to the present invention.

Referring to FIG. 6, shift ratchet 6 is assembled to shaft end part 42 of driven shaft 4 neither loose-fitted nor tight-fitted, and has at least two hooking jaws 61 onto its outer periphery. Here, hooking jaws 61 function only when being rotated in one direction.

Successive to shift ratchet 6, clutch spring 7 is fitted such that one end 71 of clutch spring 7 is inserted into a discontinuous groove 62 of shift ratchet 6 and the other end 72 thereof is inserted into a discontinuous groove 52 of shift cam 5 to mutually connect them.

Then, shift cam 5 follows clutch spring 7. After shift cam 5 is fitted into an edge end 43 stepped at driven shaft 4, an E-ring 9 is joined for fastening to avoid the escape of shift cam 5.

More preferably, edge end 43 also project through a slit 22*e* formed in vertical part 22*b* of cam guider 22 to be joined with E-ring 9 at the end thereof to further inhibit the escape of cam guider 22.

At one side of driven shaft 4 fixedly attached to shift ratchet 6, a solenoid 8 is attached to side frame 1, and an operating end 81 of solenoid 8 is to be caught by hooking jaws 61 of shift ratchet 6.

In connection with the operation, the ribbon-color changing apparatus according to the present invention formed as above will be described below.

In view of the operating state of the major parts, since hooking jaws 61 of shift ratchet 6 are supported by operating end 81 of solenoid 8 to inhibit the rotation of shift ratchet 6, clutch spring 7 cannot be rotated even though driven shaft 4 is rotated. Accordingly, shift cam 5 is not rotated to be incapable of ascending/descending cartridge frame 2.

On the contrary, once solenoid 8 is operated to allow operating end 81 to be distanced from hooking jaws 61 of shift ratchet 6 while driven shaft 4 is rotated, shift ratchet 6 can be rotated. Upon the rotation of shift ratchet 6, clutch spring 7 is rotated. In turn, when the rotational elasticity is accumulated onto clutch spring 7, shift cam 5 becomes successively rotated slightly later.

When shift cam 5 is rotated, the preceding half part of cartridge frame 2 is lift up as high as the top dead point since shift cam 5 is rotated at cam guider 22 of cartridge frame 2.

Thereafter, once operating end 81 of solenoid 8 is moved again under the state that cartridge frame 2 is lifted up, it is caught by hooking jaws 61 of shift ratchet 6 to impede the rotation of shift ratchet 6. Accordingly, the state that shift cam 5 lifts up cartridge frame 2 is continued.

Now, the overall operating state will be described.

When a user intends to print the black color on the sheet of printing paper in the normal time, it is used without performing any additional manipulation. Thus, at this time, the top dead center of shift cam 5 is moved downward while both extending plates 21 of cartridge frame 2 are connected to supporting plates 11 of side frames 1 by means of pin 3. Due to this fact, cartridge frame 2 maintains the horizontal state and, therefore, the black-colored portion of the ribbon is placed in front of the print head, thereby printing recording content in black.

Contrarily, if the red color is needed to be printed (e.g., total amount, repayment and change), an unshown main control unit (e.g., CPU) of the printing apparatus operates solenoid 8.

At this time, operating end 81 of solenoid 8 as shown in FIG. 3 is moved downward to permit the rotation of shift ratchet 6. In turn, shift ratchet 6 rotates shift cam 5 via clutch spring 7, and shift cam 5 is rotated by 180° to ascend its top dead center. Then, cartridge frame 2 including cam guider 22 is escalated with the consequence of placing the red-colored portion of the cartridge ribbon in front of the printer head, thereby enabling to print the red-colored characters.

For reference, as shown in FIG. 4, the ascending/descending state of the cartridge ribbon is recognized by the interaction of a press plate 23 of cartridge frame 2 and a toggle switch 12 furnished to a substrate to be transmitted to the main control unit.

As described above in detail, the ribbon-color changing apparatus according to the present invention is improved for printing respective two colors by using the cartridge ribbon consisting of two colors, in which cam guider 22 is formed to cartridge frame 2, and shift cam 5 is rotated within cam guider 22 to ascend/descend the cartridge ribbon. As a result, the ribbon-color changing apparatus according to the present invention is favorable in its productivity and economizes the manufacturing cost resulting from the highly-simplified structure and facilitated operation thereof.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. An apparatus for changing a ribbon-color of a printer comprising:

side frames installed with respective parts for forming said printer, and formed with a pair of supporting plates projecting from respective rear corners of said side frames;

a cartridge frame having extending plates, said cartridge frame being connected to be rotatable about a pin by extending through both of said extending plates at the rear sides thereof and into said supporting plates of both side frames, and a cam guider positioned at one side of said cartridge frame;

a driven shaft installed in both of said side frames, said driven shaft being formed with a lead screw for transferring a print head;

a shift cam fitted on and idling at one end of said driven shaft;

a shift ratchet fixedly attached to said driven shaft immediately inside of said shift cam, said shift ratchet having hooking jaws on the outer periphery thereof;

a clutching means inserted between said shift cam and shift ratchet, said clutching means having ends respectively fixed to said shift cam and shift ratchet; and a hooking means fixed to said side frame, said hooking means having an operating end arranged to be caught by said hooking jaws of said shift ratchet, whereby said shift ratchet, clutching means and shift cam are rotated in accordance with the rotation of said driven shaft by a frictional force to be capable of swinging said cartridge frame up and down.

2. An apparatus for changing a ribbon-color of a printer as claimed in claim 1, wherein said cam guider comprises:

a horizontal part obtained by horizontally extending the bottom portion of said cartridge frame;

a vertical part obtained by bending said horizontal part to extend downward;

a lower part obtained by bending said vertical part inward; and a middle part obtained by bending said vertical part inward, whereby the height between said lower part and middle part encloses the largest diameter of said shift cam.

3. An apparatus for changing a ribbon-color of a printer as claimed in claim 1, wherein said cam guider includes a slit in the side thereof for inhibiting said shift cam from being deviated, and a shaft end part of said driven shaft protrudes through said slit, and an E-ring mounted on an edge end part thereof.

* * * * *